United States Patent [19]

Oshima et al.

[11] Patent Number: 4,490,434

[45] Date of Patent: Dec. 25, 1984

[54] THERMAL DYE-TRANSFER TYPE RECORDING SHEET

[75] Inventors: Hiroyo Oshima; Isao Kano; Yutaka Kojima; Kazuo Harada; Takeo Konno, all of Tokyo, Japan

[73] Assignee: Jujo Paper Co., Ltd., Tokyo, Japan

[21] Appl. No.: 470,460

[22] Filed: Feb. 28, 1983

[30] Foreign Application Priority Data

Mar. 2, 1982 [JP] Japan ..... 57-31781

[51] Int. Cl.[3] ..... B41M 5/26

[52] U.S. Cl. ..... 428/341; 8/471; 428/206; 428/207; 428/211; 428/328; 428/330; 428/342; 428/913; 428/914

[58] Field of Search ..... 8/471; 428/206, 207, 428/211, 331, 537, 913, 914, 328–330, 340–342, 537.5

[56] References Cited

FOREIGN PATENT DOCUMENTS 26096 4/1981 European Pat. Off. ..... 8/471

142692 11/1980 Japan ..... 8/471

*Primary Examiner*—Bruce H. Hess

*Attorney, Agent, or Firm*—Koda and Androlia

[57] ABSTRACT

A recording sheet for thermal-dye transfer type recording having a coating layer which is placed on a substrate which is contacted with a coloring material layer containing sublimable dye and on which the dye is transferred by heating, wherein the coating layer includes both particular fine silica and particular binder, whereby the sheet provides a clear record with superior color density.

3 Claims, No Drawings

THERMAL DYE-TRANSFER TYPE RECORDING SHEET

BACKGROUND OF THE INVENTION

1. Field of the Invention

The present invention relates to a thermal-dye transfer type recording sheet, and more particularly to a recording sheet for a thermal-dye transfer type recording, in which a coloring material layer containing sublimable dye is provided on a base sheet, the coloring material layer is brought into contact with a recording sheet and the dye is transferred to the recording sheet by heating with a thermal head or the like.

2. Prior Art

In the thermal recording methods there is a widely adopted method in which a heat-sensitive paper having thereon a recording layer to be colored under heating by a physical or chemical change is brought into contact with a thermal head and then a record of a desirable color is obtained on the heat-sensitive recording paper. The heat-sensitive recording method, however, is defective in that coloration or contamination is readily caused in a heat-sensitive recording paper because of pressure or heat unavoidably being applied to the heat-sensitive recording paper during storage or during handling and in that a highly resolved multichromatic recording is difficult to achieve technically.

As a means for overcoming the above defects of the conventional heat-sensitive recording method, there has been proposed a method as disclosed in the Japanese patent application Laid-Open Specification No. 15,446/76. It discloses a substrate, such as paper or resin film, coated with a coloring material which is solid or semi-solid at room temperatures, the coloring material coated on the substrate is brought into contact with a recording sheet and the coloring material on the substrate is selectively transferred to the recording sheet by heating by a thermal head to perform recording.

As such recording method, there can be used a wet system and a dry system. The wet system includes melting and softening the binder in the coloring material layer and adhering and transfering binder with the dye to the recording sheet, in thermal transfer recording. In the dry system, sublimable dye is used in the coloring material layer, and the adsorption on the recording sheet is carried out by sublimating the dye.

As the coloring material layer in the dry system, there is used a substance which is prepared by kneading a binder and sublimable dye having a sublimation temperature of 60° to 300° C.

Such sublimable dye having a sublimation temperature of 60° to 300° C. are, for example, disperse dyes of the nitro, azo, quinolipe and anthraquinone types. The transfer of the dye to the recording sheet does not occur at usual temperatures even when the coloring material layer is brought into contact with the recording sheet, but the transfer of the dye occurs, first when the coloring material layer is heated to 60°–500° C. and then the dye is sublimated. In each case, conventional plain paper can fundamentally be used.

In contrast to the wet system in which the color material layer itself is transferred, the dry system has a feature that the clearness and color density of the recording image depend on the degree of the adsorption or fixation of sublimable dye to the recording sheet surface. Accordingly, when conventional plain paper is used in the dry system in which a sublimable dye having poor affinity to fiber is applied, excellent color density cannot be obtained.

The Applicant noted in the Japanese patent application No. 182,894/1980 that the recording sheet with a coating layer comprising a saturated polyester or a mixture of saturated polyester and polyvinyl pyrrolidone provides excellent color density.

SUMMARY OF THE INVENTION

An object of the present invention is to provide a thermal-dye transfer type recording sheet having a very clear record with superior color density.

The above object is obtained by using a coating layer including both fine silica having more than 250 $cm^2/g$ specific surface area measured by the BET-method and at least one binder selected from the group consisting of casein, guar gum, polyvinyl alcohol, polyacrylic amide, sodium polyacrylate, polyvinyl pyrrolidone, carboxymethol cellulose, hydroxyethyl cellulose, styrene butadiene copolymer latex, polyacrylic ester, saturated polyester and unsaturated polyester on the base sheet of the thermal-dye transfer type recording sheet.

DETAILED DESCRIPTION OF THE INVENTION

Fine silica contains silica dioxide as main constituent and is a white fine powder having an average particle size of less than 20$\mu$. It is generally called white carbon, silica gel, etc. As fine silica, there may be used silica having a masked hydroxyl group by physical or chemical treatment. In general, the larger the specific surface of fine silica is, the greater the sublimable-dye absorbency is and the higher the color density is. Therefore, it is desirable to use porous fine silica having a specific surface area of more than 150 $m^2/g$, prefereably more than 250 $m^2/g$.

The thermal dye-transfer type recording sheet of the present invention is prepared by coating on a base sheet with a coating color containing both an aqueous solution or dispersion of natural or synthetic water-soluble polymer and a solution of synthetic polymer in a solvent or an aqueous dispersion of a synthetic polymer, in appropriate proportion. The coating color is applied at a coating weight of 5–15 $g/m^2$ with a size press system or coater system such as blade coater, air knife coater, roll coater, etc.

Examples of the binder which may be used in the present invention are starch, casein, guar gum, polyvinyl alcohol, polyacrylic amide, sodium polyacrylate, polyvinyl pyrrolidone, carboxymethyl cellulose, hydroxyethyl cellulose, styrene butadiene polymer latex, polyacrylic ester, saturated polyester and unsaturated polyester.

When high brightness of the coating layer is required, there may, if desired, be used a conventional pigment such as natural ground calcium carbonate, precipitated calcium carbonate, titanium dioxide, barium sulfate, etc. Examples of the base sheet for the thermal dye-transfer type recording sheet of the present invention are plain paper, board paper, fabric non-woven fabric and resin film.

The present invention will now be described in detail with reference to the following Examples that by no means limit the scope of the present invention.

EXAMPLE 1

As the examples of the present invention, three coating colors were prepared by mixing 10 parts by weight (as a solid) of a 20% aqueous dispersion of oxidized starch (Ace B, manufactured by OJI CORNSTARCH CO., LTD) independently with 90 parts by weight (as a solid) of each slurry of silica gel (SYLOID, manufactured by FUJI-DAVISON CHEMICAL LTD.), of white carbon (CARPLEX FPS-1, manufactured by Shionogi & Co., Ltd.) and of white carbon (Silton A, manufactured by Mizusawa Industrial Chemicals Ltd.).

As reference examples, fine coating colors were prepared by mixing 10 parts by weight (as a solid) of a 20% aqueous dispersion of oxidized starch independently with 90 parts by weight (as a solid) of each slurry of natural ground calcium carbonate (FC-20, manufactured by Maruo Calcium Co., Ltd.), of precipitated calcium carbonate (Akadama, manufactured by Maruo Calcium Co., Ltd.), of titanium dioxide, of kaolin and of talc. The coating colors were coated at a coating weight of 15 g/m$^2$ on a commercial fine paper (a basis weight of 102 g/m$^2$) to obtain thermal-dye transfer types sheets Nos. 1 through 8.

Separately, sublimable thermal transfer inks of blue, yellow and red were prepared by kneading 10 parts by weight of each of the following three sublimable disperse dyes; namely Disperse Blue 24 (marketed under the tradename of "Duranol Blue 2G"),Disperse Yellow 42 (marketed under the tradename of "Resolin Yellow GRL") and Disperse Red 1 (marketed under the tradename of "Celliton Scarlet B"), independently with 3 parts by weight of polyvinyl butyral and 45 parts by weight of isopropyl alcohol by means of a three-roll mixing mill. A tissue paper having a basis weight of 30 g/m$^2$ was solidly gravureprinted with these inks to obtain a transfer substrate. The printed surface of the transfer substrate was brought into contact with the coated surface of the above-described thermal-dye transfer type recording sheet and the assembly was pressed at a pressure of 0.21 kg/cm$^2$ for 1 second to a thermal plate of 3 cm×3 cm maintained at 220° C. so that the back face of the transfer substrate was faced to the thermal plate, whereby thermal transfer to the thermal recording sheet was performed. The reflective optical densities of the blue, yellow and red recorded surface were measured by using a macbeth densitometer. Incidentally, the reflective optical densities were measured by using a visual filter (Wratten No. 106) for the blue color, a blue filter (Wratten No. 47) for the yellow color and a green filter (Wratten No. 58) for the red color.

TABLE 1

Test results obtained in Example 1

| Thermal dye-transfer type recording sheet | | Pigment in coating color | | Reflective optical densities | | | |
|---|---|---|---|---|---|---|---|
| | No | Kind | Specific surface area (BET, m$^2$/g) | Blue | Yellow | Red | Total |
| Present inventions | 1 | Silica gel (SYLOID 72) | 300 | 1.76 | 0.75 | 1.63 | 4.14 |
| | 2 | White carbon (CARPLEX EPS-1) | 300 | 1.49 | 0.72 | 1.53 | 3.74 |
| | 3 | White carbon (Silton A) | 250 | 1.42 | 0.74 | 1.36 | 3.52 |
| Reference example | 4 | Natural ground calcium carbonate (FC-20) | — | 1.17 | 0.67 | 1.14 | 2.98 |
| | 5 | Precipitated calcium carbonate (Akadama) | 4.8 | 1.12 | 0.59 | 1.16 | 2.87 |
| | 6 | Titanium dioxide | — | 0.81 | 0.50 | 0.80 | 2.11 |
| | 7 | Kaolin | 13.9 | 0.87 | 0.56 | 0.85 | 2.28 |
| | 8 | Tale | — | 0.95 | 0.50 | 1.00 | 2.45 |
| | 9 | Base Paler (Fine paper) | | 0.66 | 0.40 | 0.69 | 1.75 |

Note:
High reflective optical density means good color density.

As is seen from the results shown in Table 1, the reflective optical densities of the thermal-dye-transfer type recording sheets Nos. 1 through 3 containing the fine silica of the present invention were much higher than those of the thermal recording sheets Nos. 4 through 8 prepared by using customary paper coating pigments. When the base paper free of the coating layer (thermal-dye-transfer type recording sheet No. 9) was similarly tested, there was obtained only a low reflective optical density.

EXAMPLE 2

Six coating colors were prepared by mixing 25 parts by weight (as a solid) of 15% aqueous solution of wholly saponificated polyvinylalcohol (PVA-117, manufactured by KURARAY CO., LTD.) with 75 parts by weight (as a solid) of each slurry of the following fine silicas:

Silica gel (SYLOID 72, manufactured by FUJI-DAVISON CHEMICAL LTD.)

Silica gel (SYLOID 404, manufactured by FUJI-DAVISON CHEMICAL LTD.)

White carbon (CARPLEX FPS-1, manufactured by Shionogi & Co. Ltd.)

White carbon (Silton A, manufactured by Mizusawa Industrial Chemicals, Ltd.)

White carbon (Nipsil E200A, manufactured by NIPPON SILICA INDUSTRIAL CORPORATION)

White carbon (Mizukasil NP-8, manufactured by Mizusawa Industrial Chemicals, Ltd.)

These coating colors were coated at a coating weight of 5 to 9 g/m$^2$ on a commercial fine paper having a basis weight of 102 g/m$^2$ to obtain thermal-dye transfer type recording sheets Nos. 10 through 15.

The reflective optical densities of the recorded surfaces of the thermal-dye transfer type recording sheets were measured in the same manner as described in Example 1. The obtained results where shown in Table 2.

TABLE 2

| Test results obtained in Example 2 | | | | | | | |
|---|---|---|---|---|---|---|---|
| Thermal dye-transfer type recording sheet Pigment in coating color | | | | Reflective optical densities | | | |
| No. | Kind | Specific surface area (BET, $m^2/g$) | average particle size (sedimentation-method, $\mu$) | Blue | Yellow | Red | Total |
| 10* | SYLOID 72 | 300 | 4 | 1.63 | 0.76 | 1.61 | 4.00 |
| 11* | SYLOID 404 | 300 | 10 | 1.59 | 0.74 | 1.62 | 3.95 |
| 12* | CARPLEX FPS-1 | 300 | 1.5 | 1.46 | 0.71 | 1.45 | 3.62 |
| 13* | Silton A | 250 | 4 | 1.37 | 0.69 | 1.39 | 3.45 |
| 14* | Nipsil E200A | 130 | 2.3 | 1.41 | 0.69 | 1.23 | 3.33 |
| 15* | Mizukasil NP-8 | 150 | 2.5 | 1.42 | 0.68 | 1.26 | 3.36 |

*Present Invention

As is apparent from the results shown in Table 2, the reflective optical densities of the thermal-dye transfer type recording sheets No. 10 through 15 containing fine silica in the coating layer provide superior reflective optical densities, even in case of using a binder of 25% (more than 10% in Example 1) into coating color.

In comparison of reflective optical densities of various thermal-dye transfer type recording sheets Nos. 10, 12, 13 in Table 2 and Nos. 1 through 3 in Table 1, it was found that the large addition of binder into the coating color in the present invention using fine silica gives inferior reflective optical density.

As seen from Table 2, in the thermal-dye transfer type recording sheets of the present invention, the average particle size of fine silica is independent of the reflective optical density of the recording sheet. But it is evident that the larger the specific surface area, which is a measure of the porosity of fine silica, the greater is the reflective optical density of the recording sheet.

We claim:

1. Thermal-dye transfer type recording sheet having a coating layer prepared by coating on a base sheet with coating color at a coating weight of 5–15 $g/m^2$ with a sizing press system or coating system, said coating layer being contacted with a coloring material layer containing sublimable dye on a substrate, said coloring material being selectively transferred on said coating layer by heating, wherein said coating layer comprises both fine silica having more than 250 $cm^2/g$ specific surface area measured by the BET-method and at least one binder selected from the group consisting of casein, guar gum, polyvinyl alcohol, polyacrylic amide, sodium polyacrylate, polyvinyl pyrrolidone, carboxymethyl cellulose, hydroxyethyl celluluose, styrene butadiene copolymer latex, polyacrylic ester, saturated polyester and unsaturated polyester.

2. Thermal-dye transfer type recording sheet according to claim 1, wherein said coating layer further comprises at least one pigment selected from the group consisting of natural ground calcium carbonate, precipitated calcium carbonate, titanium dioxide and barium sulfate.

3. Thermal-dye transfer type recording sheet according to claim 1, wherein said coating layer is coated on said recording sheet at 5–15 $g/m^2$.

* * * * *